United States Patent [19]

Engelhardt

[11] Patent Number: 4,706,846

[45] Date of Patent: Nov. 17, 1987

[54] TAG DISPENSER

[76] Inventor: Bernard Engelhardt, 51 Abbeywood Trail, Don Mills, Ontario, Canada, M3B 3B4

[21] Appl. No.: 889,744

[22] Filed: Jul. 28, 1986

[51] Int. Cl.[4] ..... B65H 1/08

[52] U.S. Cl. ..... 221/232; 221/268; 221/304; 227/67; 271/138

[58] Field of Search ..... 221/224, 226, 232, 268, 221/304; 227/18, 67, 40, 48, 3; 271/129, 137, 138

[56] References Cited

U.S. PATENT DOCUMENTS

| | | | |
|---|---|---|---|
| 213,000 | 3/1979 | Sperry | 221/304 X |
| 2,069,878 | 2/1937 | Flood | 227/67 X |
| 2,503,903 | 4/1950 | Cunningham et al. | 227/48 X |
| 3,022,508 | 2/1962 | Ruskin | 221/232 X |
| 3,070,260 | 12/1962 | Smith | 221/232 X |
| 3,103,666 | 9/1963 | Bone | 227/67 |
| 3,308,989 | 3/1967 | Alltop et al. | 221/232 |
| 3,393,831 | 7/1968 | Stewart | 221/232 |
| 3,412,895 | 11/1968 | Hilton | 221/268 X |
| 3,735,908 | 5/1973 | Kinney et al. | 227/67 |
| 3,924,788 | 12/1975 | Furutu | 227/67 |
| 4,038,922 | 8/1977 | McGregor | 271/129 X |
| 4,085,863 | 4/1978 | Johnson | 221/304 X |
| 4,323,183 | 4/1982 | Duchin | 227/18 X |
| 4,405,124 | 9/1983 | Watanabe | 271/138 X |
| 4,487,354 | 12/1984 | Ueno | 227/67 |
| 4,538,754 | 9/1985 | Furutsu | 227/67 |
| 4,610,384 | 9/1986 | Duchin | 227/67 |

FOREIGN PATENT DOCUMENTS

| | | |
|---|---|---|
| 318771 | 1/1932 | Canada . |
| 753510 | 2/1967 | Canada . |
| 1103625 | 6/1981 | Canada . |

*Primary Examiner*—Robert J. Spar
*Assistant Examiner*—P. McCoy Smith
*Attorney, Agent, or Firm*—Fleit, Jacobson, Cohn & Price

[57] ABSTRACT

A tag container has a dispensing wall and contains a plurality of tags which are stackable in parallel to the dispensing wall. In the top wall of the container is a dispensing opening through which tags may be dispensed from the container by a slider which is slideable up and down along the dispensing wall. The slider includes a pusher portion which engages the bottom edge of a tag to push it upwardly and out through the dispensing opening.

9 Claims, 10 Drawing Figures

TAG DISPENSER

BACKGROUND OF THE INVENTION

1. Field of the Invention

The invention relates to improvements in a fastener dispensing device which dispensing device includes a trigger means for activating a push rod to extend through a stationary hollow needle member, the needle member having a free, front end, whereby to anchor a fastener to a fabric material or other pierceable material.

More specifically, the invention relates to means for positioning the product over the stationary needle during the fastening operation.

Typically, the fastener is used to attach tags, labels, or the like to the fabric material or other product in such a manner that, after the fastening operation is completed, the tag is mounted on the fastener and the fastener is anchored to the product so that the tag is attached to the product by the fastener.

The invention also relates to a tag dispenser for use with the fastener dispensing device which automatically places a tag in position to be mounted on the stationary needle before each fastening operation.

The invention also relates to the tag dispenser, per se.

2. Description of Prior Art

Devices of the above nature are known in the art as illustrated in, for example, U.S. Pat. Nos. 2,069,878, Flood, Feb. 9, 1937, 3,103,666, Bone, Sep. 17, 1963, 3,924,788, Furutu, Dec. 9, 1975, 4,487,354, Ueno, Dec. 11, 1984 and 4,538,754, Furutsu, Sep. 3, 1985.

The above patents relate to the device per se and to improvements in the dispensing operation of the device. In operation of the device, the material to which the fastener is to be anchored is held in one hand with two fingers of the one hand being placed on either side of the spot at which the fastener is to be anchored. The fingers spread the material apart whereby to maintain the material between the fingers taut and rigid. The device is held in the other hand and a tag is mounted, usually manually, on the needle. The needle is pushed through the material between the two fingers of the one hand. It will be appreciated that it is necessary to so hold the material as a taut surface is necessary if the needle is to penetrate the material.

The needle is pushed through the material from one side (usually the front) to the other side (usually the back) and one bar of the fastener remains on the one side while the other bar of the fastener is disposed on the other side, as described in the above patents, so that the fastener is anchored to the material. The tag remains on the one side mounted on the filament of the fastener (the filament connects the bars) so that the tag is attached to the material by the fastener.

The device is used for affixing tags to clothing and other products made of a pierceable material. The tags can contain such information as the size of the product, the cost of the product or inventory information for the retail outlet.

The problem with the above-described procedure is that it is, outside of the affixing step performed by the device, an entirely manual procedure which is therefore labor intensive and, accordingly, very costly. In addition, there is the danger that a worker applying the fastener will pierce his finger with the needle so that there is a certain degree of danger to the operators of the procedure. Further, because the needle of the dispensing device is stationary, the fastening operation is not easily automated.

It can be seen that the manual steps which are performed by an operator are as follows:

1. Mounting the tag on the needle;
2. Holding the material;
3. Bringing the needle to the material (or vice-versa); and
4. Piercing the material with the needle and then dispensing the fastener.

Although there are some machines which automate some or all of the above steps, the machines are typically fairly large, complex and expensive. In addition, the machines are fixed in place so that it is always necessary to bring the articles of clothing (or other product) to the machine. Thus, although these machines do eliminate manual labor in one respect, they impose manual labor in a different respect, that is, it is necessary to manually bring the product to the machines and then to return the product to either hangers or other carriers after the fastening operation has been completed.

SUMMARY OF INVENTION

It is an object of the invention to provide an improvement to a fastener dispensing device of the above-described nature which overcomes the disadvantages of the prior art.

It is a more specific object of the invention to provide an improvement to a fastener dispensing device of the above-described nature which automates certain steps in the fastening procedure.

It is a more specific object of the invention to provide an improvement to a fastener dispensing device of the above-described nature which improvement automates the step of the positioning the product on the stationary needle of the dispensing device.

It is a still further object of the invention to provide an improvement to a fastener dispensing device of the above-described nature which automates the step of bringing the product to the needle, piercing the product with the needle and aiding in the dislodgement of the fastener from the dispensing device.

It is a still further object of the invention to provide a tag dispenser for use with the fastener dispensing device which automates the tag positioning step of the above procedure.

It is a still further object of the invention to provide a tag dispenser per se.

In accordance with the invention, a tag dispenser includes a tag container for containing a plurality of tags. The tag container has a top wall and a dispensing wall, and the tags are stackable in the container in parallel with the dispensing wall. A dispensing opening, through which tags may be dispensed from the container, is included in the top wall. Slide means for pushing a tag out of the container through the dispensing opening are slideable along the dispensing walls. Means are included for moving the slide means up and down along the dispensing wall.

BRIEF DESCRIPTION OF DRAWINGS

The invention will be better understood by an examination of the following description together with the accompanying drawings in which.

DESCRIPTION OF PREFERRED EMBODIMENTS

Figure 1:
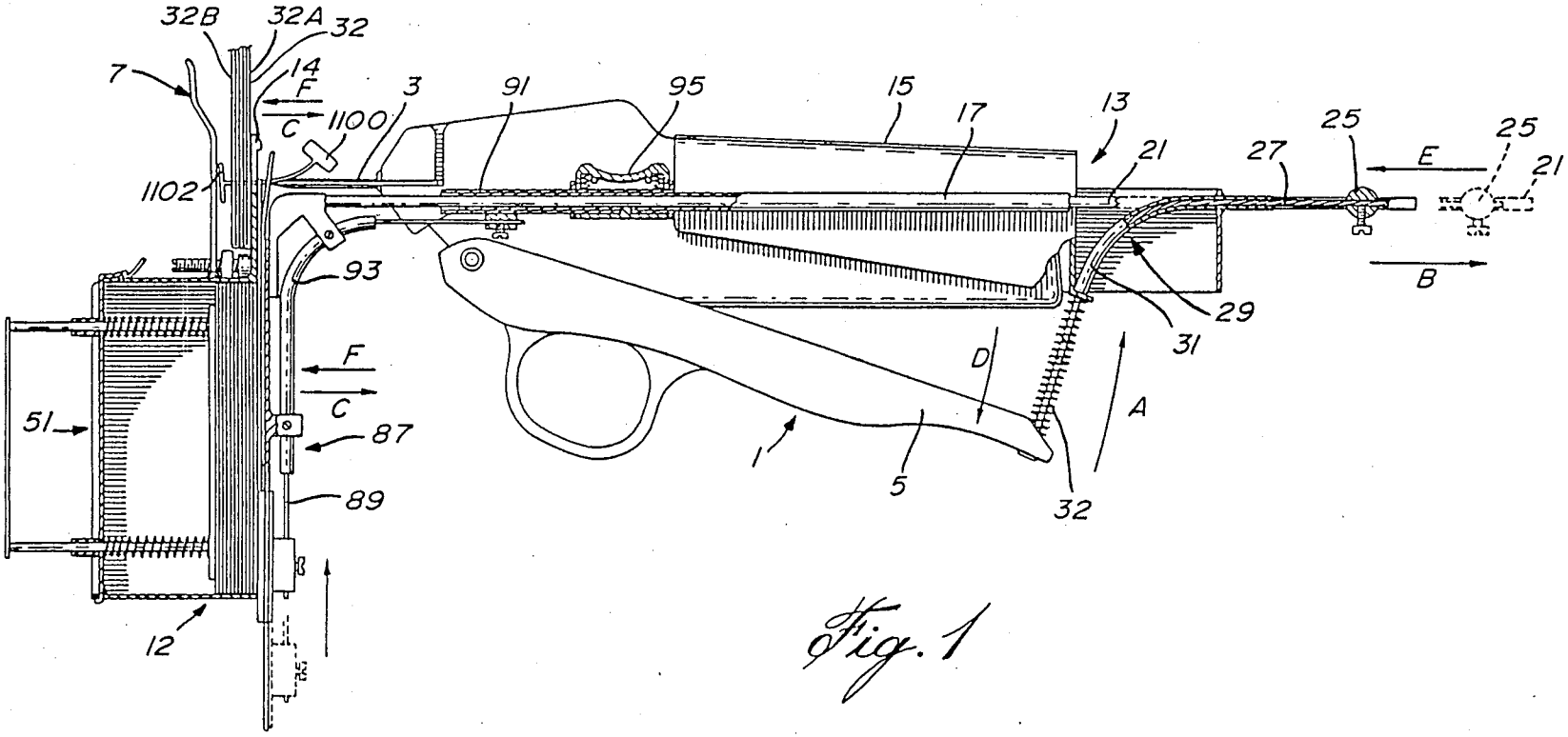
FIG. 1 is a side view of the fastener dispensing device with attachments with the trigger means of the fastener dispensing device in its rest position.

Referring to the drawings, a fastener dispensing device of the above-described nature is illustrated generally at 1 and includes a stationary hollow needle member 3 at the front end thereof, the hollow needle member having a free front end. The device also includes a trigger means 5.

Figure 3:
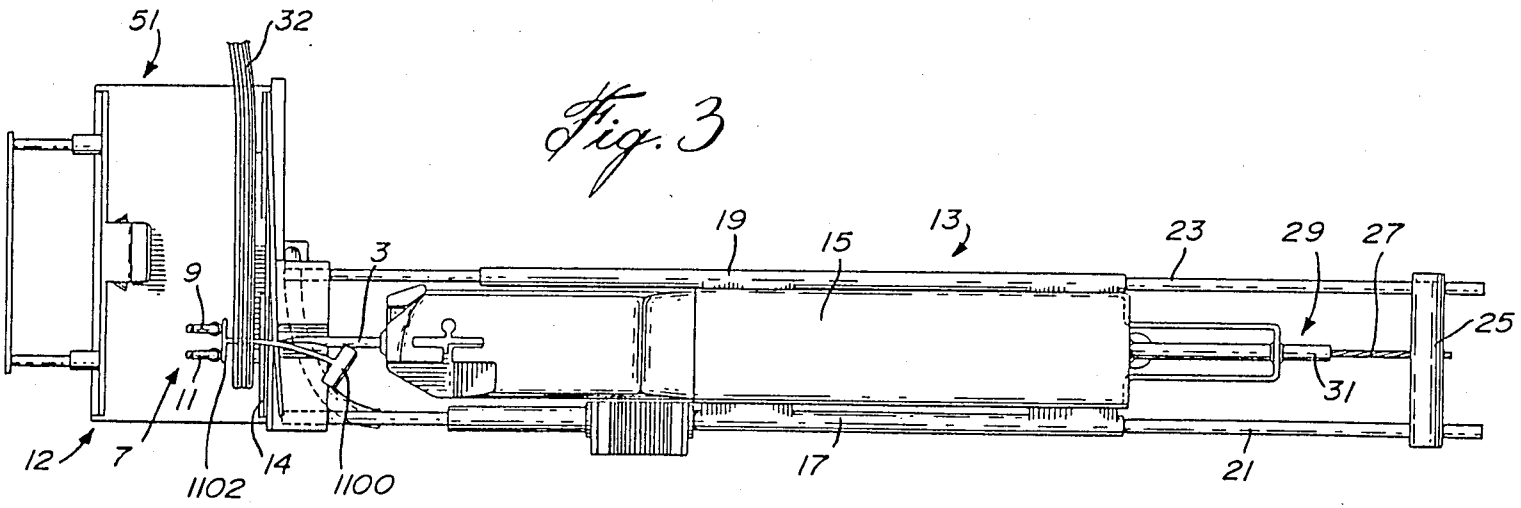
FIG. 3 is a top view of FIG. 1.

In order to automate the product positioning, there is provided, in accordance with the invention, a position means 7 which includes two spaced hook-like fingers 9 and 11 (see FIG. 3). The fingers 9 and 11 are disposed on a carrier 12 on either side of the hollow needle 3. As will be seen below, in the illustrated embodiment, the carrier 12 comprises the tag dispenser and it includes a backplate 14.

In order to automate the step of bringing the positioned product to the needle, there is provided a moving means illustrated generally at 13. The moving means comprises the carrier 12 and a saddle 15 which is mounted on the device 1. Attached to each side of the saddle are guide members comprising tubular members 17 and 19. As can be seen, the tubular members are disposed in parallel arrangement. In addition, the tubular members are parallel to the needle 3.

Extending through the tubular members 17 and 19 are sliding members comprising rods 21 and 23 respectively which rods are slidable within their respective tubes. The rods are connected together by bar 25 at the rear end of the device 1. The rear end of the device is, as clearly seen, the end opposite to the end having the needle 3. The front ends of the rods 21 and 23 are connected to the carrier 12.

A force transmitting means, such as a cable 27 is connected at one end thereof to the trigger means 5 and, at the other end thereof, to the bar 25. The cable extends through a guide means 29 which includes a curved tubular member 31, whereby the cable is guided to the bar 25. The guide means 29 may also include a handle return means such as spring 32, should such a return means be necessary.

Figure 2:
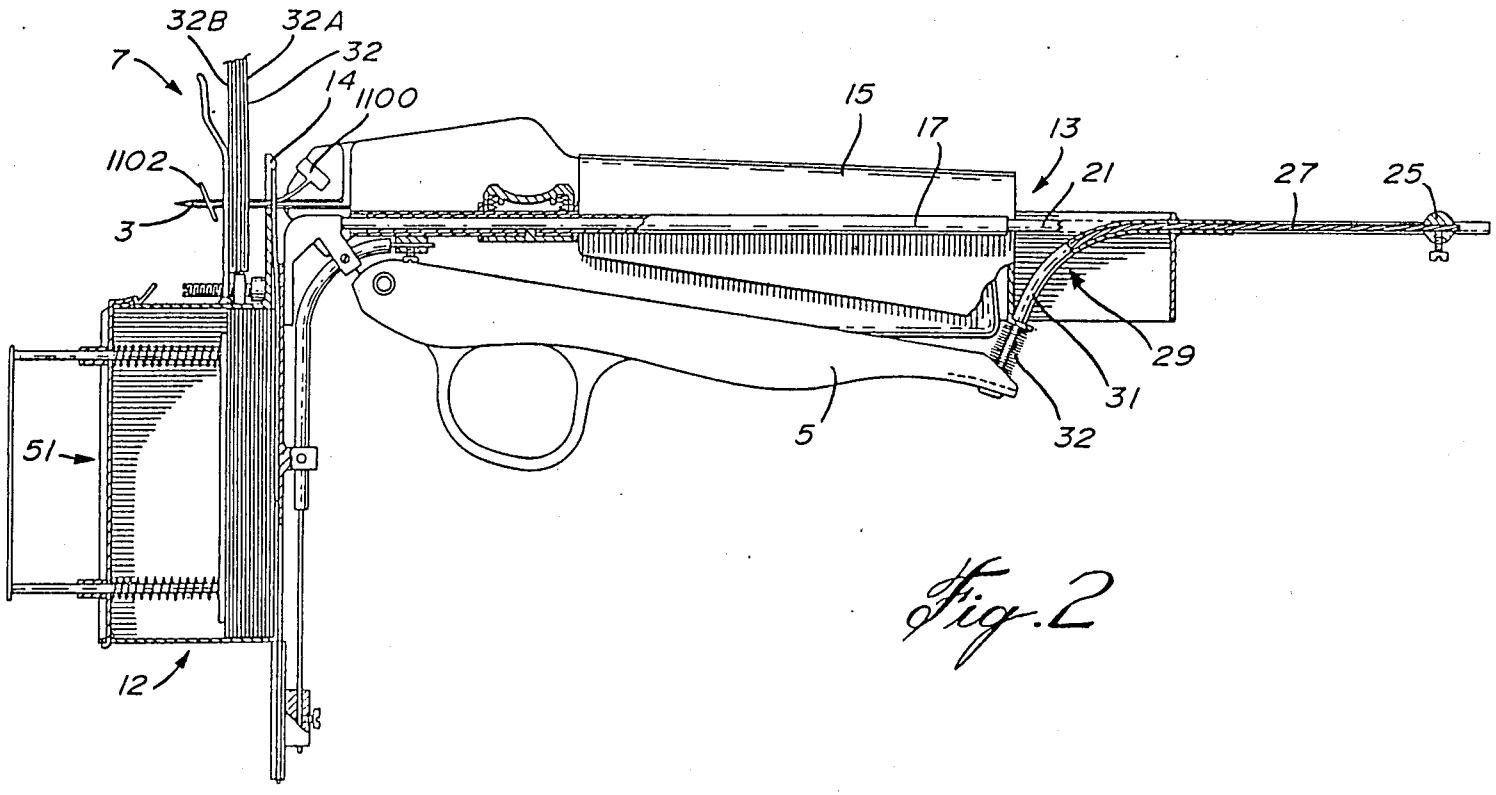
FIG. 2 is the same view as FIG. 1 but with the triggering means of the fastener dispensing device in its fully retracted position.

In operation, the apparatus is in its rest position as illustrated in solid lines in FIG. 1. The operator then places the apparatus to position a portion 32 of a product between the fingers 9 and 11 and the backplate 14. The portion 32 can be, for example, the free edge of a sleeve of a coat, the collar of a coat or blouse, the bottom edge of a garment, etc. The trigger means is then moved in the triggering direction (see direction of arrow A in FIG. 1) to activate the device. At the same time, the cable 27 will be forced upwardly and rearwardly and, as the cable 27 is connected to the bar 25, the bar 25 will be moved rearwardly (in the direction of arrow B in FIG. 1). As rods 21 and 23 are connected to bar 25, they will also move rearwardly in the direction of arrow B, and as these rods are connected to the carrier 12, the carrier 12 will move rearwardly in the direction of arrow C. As the carrier is moved towards the needle, the needle will pierce the portion 32 of the product and pass, from one side 32A of the portion 32, to the other side 32B of the product when the trigger means 5 is in its fully retracted position as shown in FIG. 2. As seen in FIG. 2, the needle extends through the portion 32 of the product beyond the side 32B so that the needle can eject the fastener 1100 as taught in the references cited above.

The trigger means 5 is then released so that it moves in the direction of arrow D in FIG. 1. When the trigger means 5 moves in the direction of arrow D, cable 27 is pulled forwardly and downwardly so that bar 25 is moved forwardly in the direction of arrow E. Rods 21 and 23 are moved in the same direction whereby to push the carrier 12 forwardly in the direction of arrow F. At the end of a cycle, as shown in FIG. 1, the fastener 1100 is released from the needle. As will be seen below, a tag or label can be mounted on the fastener whereby the tag or label will be attached to the product.

Figure 4:
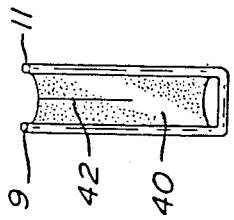
FIG. 4 illustrates a further modification of the invention.

In order to assist in the ejection of the fastener 1100 from the needle, a web 40 may be disposed between the fingers 9 and 11 as shown in FIG. 4. The web can comprise a rubber-like material and would include a central slit 42 which extends to the top of the web. The slit will permit passage of the needle 3 through the web, but will prevent passage of the bar 102 through the web. Thus, the web will assist in the ejection of the fastener 1100 from the needle 3.

As will be apparent from FIG. 2, the travel distance of the bar 25 must be sufficient so that the needle 3 will extend beyond the surface 32B of the portion 32 when the trigger means 5 is in its fully retracted position. The travel distance of the bar 25, in the arrangement shown, corresponds identically with the travel distance of the trigger means 5. In the event that this travel distance is not sufficient, it would, of course, be possible to use a motion amplifier, as is well known in the art, to increase the travel distance.

Although the motion of bar 25 is, in the illustrated embodiment, produced by use of a cable 27 between the trigger means 5 and the bar 25, it would be possible to use some other arrangement of motion translation as, for example, an arrangement of gears as also well known in the art. It is only necessary that the motion be produced by the action of moving the triggering means 5 in the triggering direction (arrow A) so that the piercing of the product portion be coincident with the ejection of the fastener 1100 from the needle 3.

It can thus be seen that, with the improvement described, an operator need merely position a portion of a product so that the fingers 9 and 11 extend adjacent one surface of the product while the needle 3 is disposed adjacent the other surface. The operator then pulls the trigger, and the improved apparatus automatically completes the fastening operation.

Although the moving means 13 has above been described as consisting of tubular guide members 17 and 19 with respective rods 21 and 23, it will be understood that these tubular members and rods could be replaced by a single guide on one side of the saddle which could comprise a hollow rectangular member. A mating rectangular rod would slide through the guide, and the rectangular rod would be connected, at one end thereof, to the carrier 12 and, at the other end thereof, to either the bar 25 or a replacement therefor.

The improved apparatus also includes a tag dispenser for automatically placing the tags in position to be mounted on the fastener before each fastening operation. In accordance with the invention, a tag is placed in such a position at the termination of a preceding fastening operation for a following fastening operation. The tag is disposed in front of the front end of the needle 3 in the space between the backplate 14 and the needle 3. The timing of the tag positioner must therefore ensure that the holder 12 has moved far enough ahead of the front of the needle 3 so that there is a space between the front end of the needle 3 and the backplate 14 for the tag to move into.

With the above in mind, and considering FIGS. 5, 6, 7, 8 and 9, the tag dispenser comprises a container 51. In the illustrated embodiment, the container is rectangular in both front view and top view.

The container comprises a dispensing wall 53 and an opposed openable opening wall 55. Tags are placed in the container through the opening when the openable wall 55 is opened.

The container also includes end walls 57 and 59, a top wall 61 and a bottom wall 63. Extending downwardly from the dispensing wall 53 is a guide wall 65. Slot 67 extends upwardly through the guide wall 65 and into the dispensing wall 53.

Figure 5:
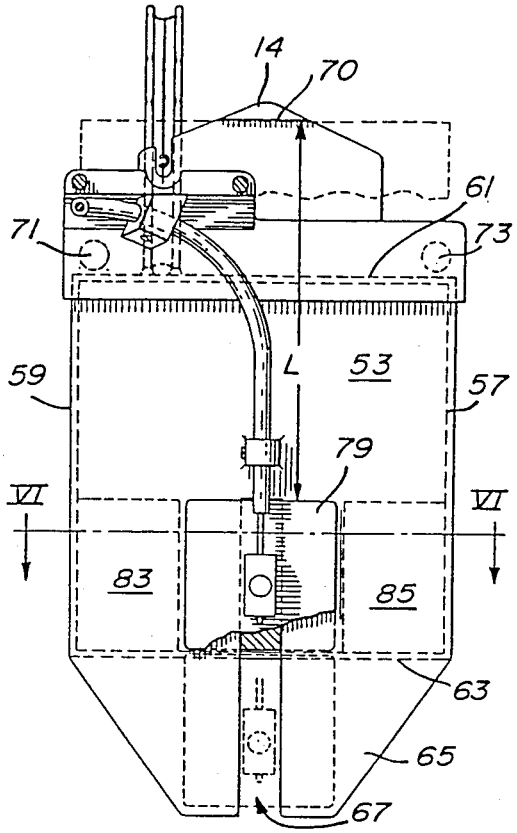
FIG. 5 is a view of the tag dispensing device as seen from the dispensing wall side.
Figure 7:
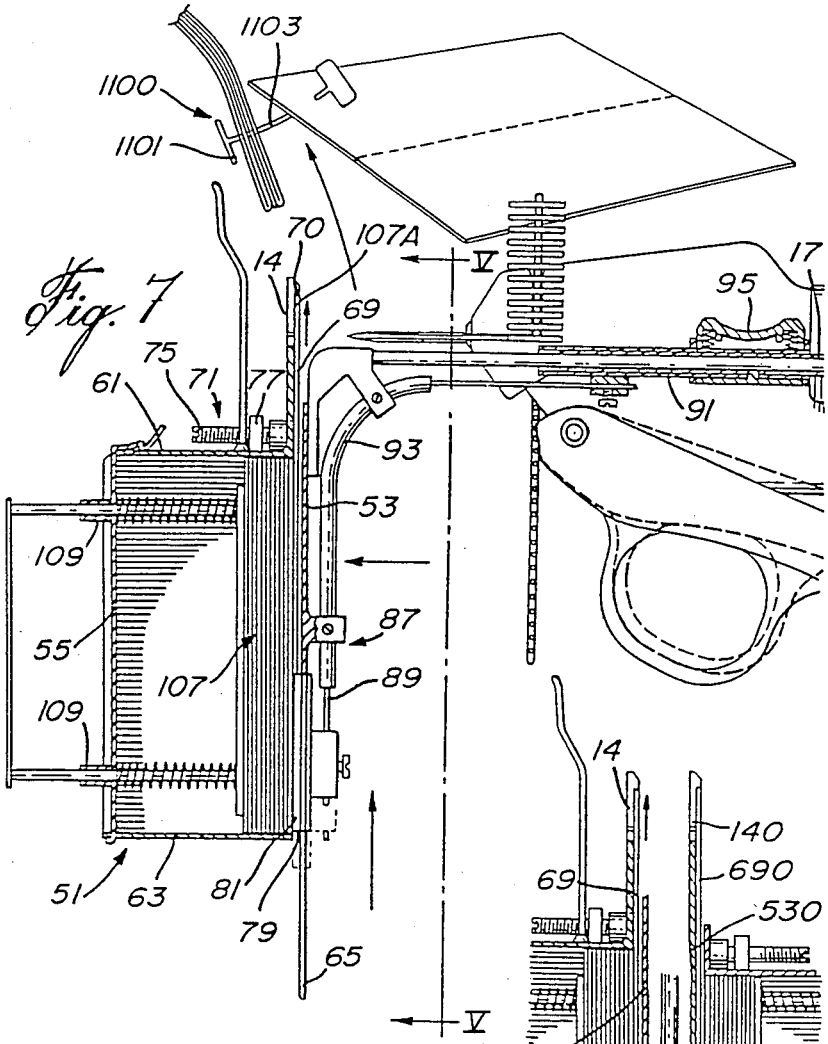
FIG. 7 is a side sectional view of the container of the tag dispenser.

A dispensing opening 69 is formed between the top of the dispensing wall 53 and the backplate 14. As seen in FIGS. 5 and 7, the backplate 14 includes a stop comprising a ridge 70 the purpose of which will be discussed below.

The width of the dispensing opening is of the order of the thickness of two tags to be dispensed. As tags may be of different thickness, a dispensing opening adjustment means 71 and 73 are included adjacent to the dispensing opening. Adjustment means 71 comprises a screw 75 and a threaded screw holder 77. Adjustment means 73 comprises a similar arrangement. Thus, the effective width of the dispensing opening can be adjusted by moving the screw 75 backwards or forwards in the screw holder 77. A similar adjustment would be made on the adjustment means 73 side.

A slider 79 is movable up and down along walls 53 and 65 and is guided in this movement by the slot 67. The slider 79 comprises a pusher portion 81 shown in FIGS. 6 and 7. The pusher section has a thickness equal to the thickness of two tags.

Disposed on the interior surface of the dispensing wall 53 are spacers 83 and 85. Each of the spacers 83 and 85 has a thickness T equal to the thickness of a single tag. The tops of the spacers 83 and 85 are in line with the top of the pusher 81 in its most upward position.

As mentioned, pusher 81 is movable vertically up and down along the slot 67. The movement is effected by an arrangement 87 (see FIGS. 7, 8 and 9) which includes a cable 89 connected at one end to the slider 79 and, at the other end, to a cylinder 91. As can be seen, the cylinder 91 is mounted on and slideable over the cylinder 17. The cable is guided from the slider 79 to the cylinder 91 by a guide means comprising a curved cylinder 93.

In accordance with the invention, the tag dispenser will operate either manually or automatically. In order to switch from manual to automatic mode and vice-versa, there is provided a thumb actuated release mechanism 95 which includes a pin 97 for engagement in opening 99 in cylinder 17 and aligned opening 100 in cylinder 91. When the pin 97 extends through both openings 99 and 100, cylinder 91 is physically connected to cylinder 17 and will move together with cylinder 17. This will hereinafter be referred to as the engagement position.

Springs 101 maintain the mechanism 95 in the engagement position.

In operation, in the automatic mode, the mechanism 95 is retained in the engagement position. Accordingly, cylinder 91 will move with cylinder 17 in the directions of the arrow G (see FIG. 9) causing cable H to move in the directions of arrow H. The mechanism is changed to the manual mode by placing the thumb in the curve portion of the mechanism and pressing downwardly in the direction of arrow I (see FIG. 8). Pin 97 will move out of opening 99 so that cylinder 91 is now free to move by sliding over the cylinder 17, i.e. it will no longer move with the cylinder 17. However, pin 97 will still be engaged in opening 100 of cylinder 91. Accordingly, when mechanism 95 is moved, cylinder 91 will move with it. The mechanism 95 can be manually moved in the directions of the arrow G whereupon the cable 89 will be caused to move in the directions of the arrow H of FIG. 9.

As can be seen, the cable 89 is connected to slider 79 by a cylinder and screw arrangement 103, and the cable 89 is connected to the cylinder 91 by a cylinder and screw arrangement 105, whereupon the cable is removable at both ends thereof.

Figure 6:
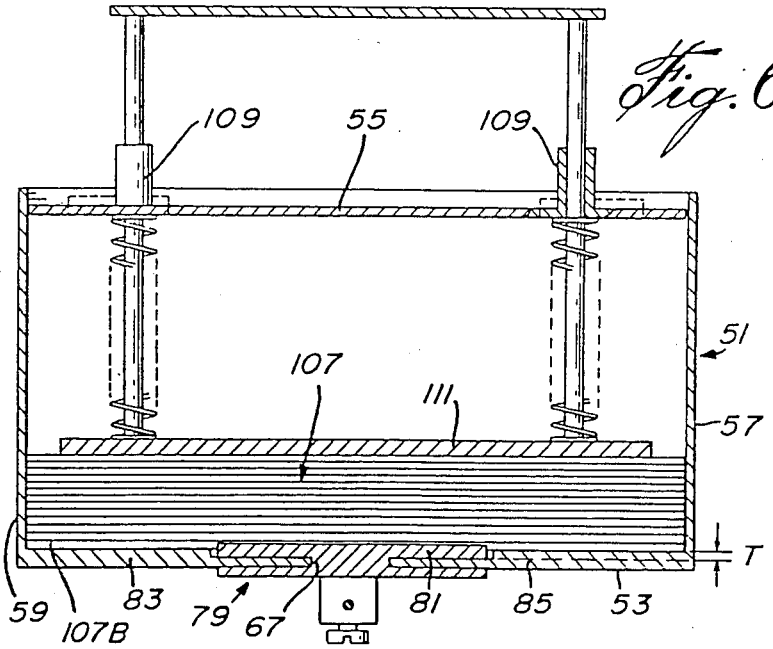
FIG. 6 is a section through VI—VI of FIG. 5.

As can be seen in FIGS. 6 and 7, the tags 107 are stacked in a vertically upright position. A spring 109 and plate 111 arrangement forces the tags up against the dispensing wall 53. The spring and plate arrangement is a schematic representation, and other physical arrangements, well known in the art, could be used for this same purpose.

In operation, a first tag 107A is placed in position so that the top of the tag abuts the ridge 70 as shown in FIG. 7. This can be accomplished manually by placing the thumb in the mechanism 95, pressing downwardly, and then moving the mechanism to the left as far as it will go. This will place the slider in the position illustrated in full lines in FIG. 9, i.e., underlying the container 51. As seen in FIG. 6, although the pusher 81 is of a thickness equal to two tags, as the spacers 83 and 85 are each of a thickness equal to one tag, the pusher 81 will engage only one tag 107B. When the mechanism 95 is moved back to the right, the one tag is moved upwardly until the top of the tag abuts the ridge 70. The length L between the ridge and the top of the spacers 83 and 85 is equal to the length of a tag. Thus, when a tag is in the position of tag 107A of FIG. 7, its inner surface will be in line with the inner surfaces of the spacers 83 and 85, preventing retraction of the tag on the return stroke of slider 79. A second tag will occupy the position illustrated at 107B in FIG. 6 and be engageable by the pusher 81 when it is moved into the position shown in full lines in FIG. 9. Because the dispensing opening 69 has a thickness equal to the thickness of two tags, it will be possible to move the second tag 107B upwardly and through the opening even while the first tag 107A is in the opening.

Figure 9:
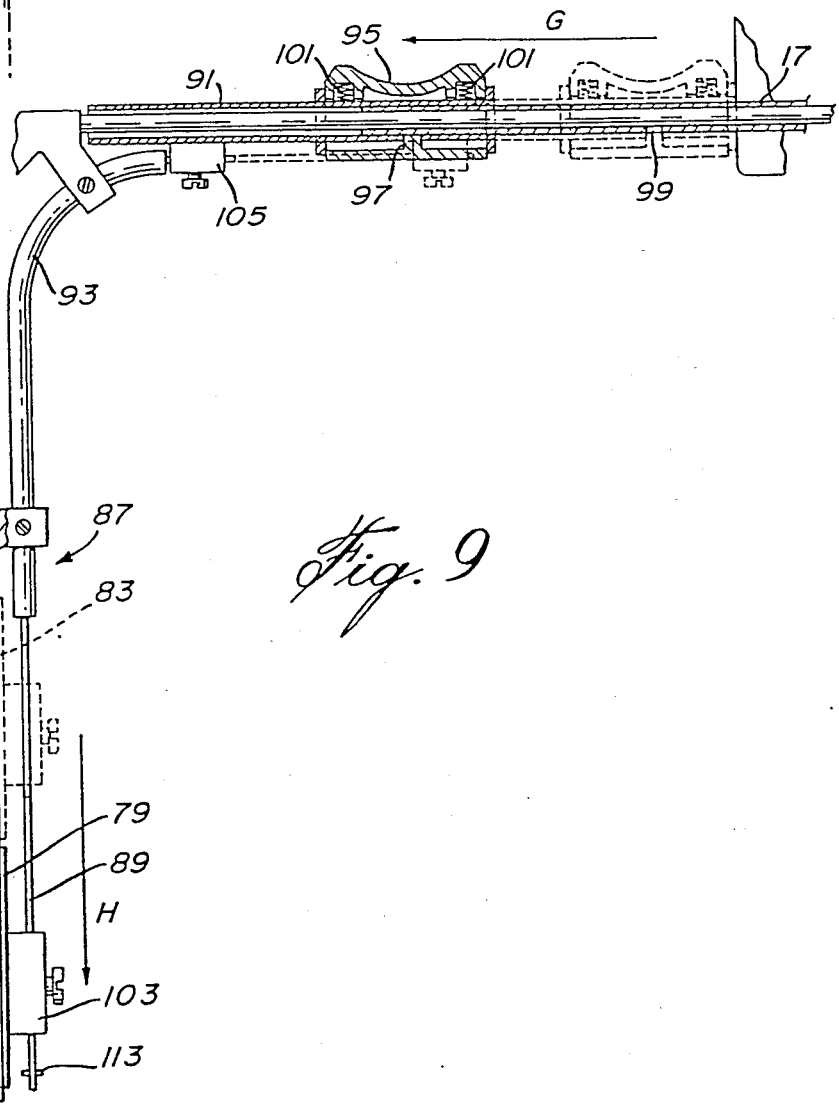

Assuming now that the mechanism is in the automatic position, when the trigger means 5 is moved in the triggering direction (in the direction of arrow A of FIG. 1) the slider 79 is moved downwardly and, when the triggering means is in its fully retracted position, will occupy the position shown in full lines in FIG. 9. When the triggering means 5 is released, the slider 79 will begin to move upwardly even as the carrier 12 begins to move away from the needle. It will be clear that the movement of the slider 79 must be synchronized with the movement of the carrier 12 so that the second tag does not reach the level of the needle 3 until such time as the needle 3 has cleared the dispensing opening 69. Such an adjustment can be made by means well known in the art. For example, as shown in FIG. 9, the cable 89 could be made slideable in the cylinder 103, and a collar 113 could be disposed adjacent the free end of the cable. Thus, the cylinder 103 will not move until such time as the collar 113 abuts it.

In any case, a second tag will move up behind the first tag and, in its movement, it may possibly engage the strand 1103 of the fastener 1100 and push the first tag upwardly. However, as the first tag is about to be removed in any case, this has no effect on the operation of the device.

When the first tag is pulled out, it may frictionally engage the second tag and attempt to pull it out as well. However, the second tag will be stopped by the ridge 70 so that it will remain in position for the next fastening operation.

It will be seen that, with a tag dispenser above-described, and in what could be referred to as a double-feeding method, the first tag does not have to be ejected before the second tag is raised to be in position for the next fastening operation. Accordingly, a lesser raising motion is required for the tags.

In comparison with prior art devices, where a first tag must be ejected before a second one can be placed in position for a fastening operation, the motion of the slider would have to be equal to at least the full length of a tag dispensed by the dispenser. When using a dispenser as above-described, it is possible, as seen in the drawings, to raise each tag by an amount far smaller than the total length of the tag. Thus, the slider 79 requires a shorter stroke.

Such advantage is especially useful with dispensing devices of the type illustrated at 1 herein as it is the motion of the triggering means 5 which provides the motion of the slider. As the motion of the triggering means 5 is limited, it is useful to have a tag dispenser wherein the slider requires only a short stroke.

A further advantage of the tag dispenser of the present application when compared to tag dispensers of the prior art, which may be referred to as single feeding dispensers, is that with the present tag dispenser, the second tag can start moving not only while the first tag is still in position, but even while the needle is still extending through the first tag. In the prior art devices, the second tag cannot start moving until such time as the first tag has been completely removed from the tag dispenser. The earliest that the first tag can be removed from the first dispenser is when the needle member no longer extends therethrough. As this occurs only after approximately three quarters of the motion of the triggering means 5 has been expended, it leaves very little motion to raise the second tag into the dispensing position. Accordingly, with a single feeding tag dispenser, it would be necessary to either amplify the motion of the triggering means 5 for its last quarter, or to provide some other complicated and cumbersome arrangement. The much simpler arrangement of the present invention is possible because of the double feeding method. With this method, it is only necessary to ensure that the second tag does not arrive in position until such time as the needle has withdrawn from the position.

In the manual mode, the initial set-up is, once again, as illustrated in FIG. 7. The mechanism 95 is kept pressed down while the trigger means is retracted and released. After the first tag is removed, the mechanism 95 is moved first to the left and then to the right to thereby place a second tag in position so that the set-up is once again as illustrated in FIG. 7. With this arrangement, it is not necessary to be able to pass a second tag through the dispensing opening 69 while a first tag is in the dispensing opening. Accordingly, the dispensing opening can be made equal to the thickness of only a single tag. Similarly, the pusher need have a thickness equal to only a single tag, and spacers 83 and 85 are not needed. It is also possible, in accordance with the invention, to dispense labels instead of tags, and the labels could be contained on a roll. The pusher 81 would then be replaced with, for example, pins which would engage mating openings in each label.

Figure 10:
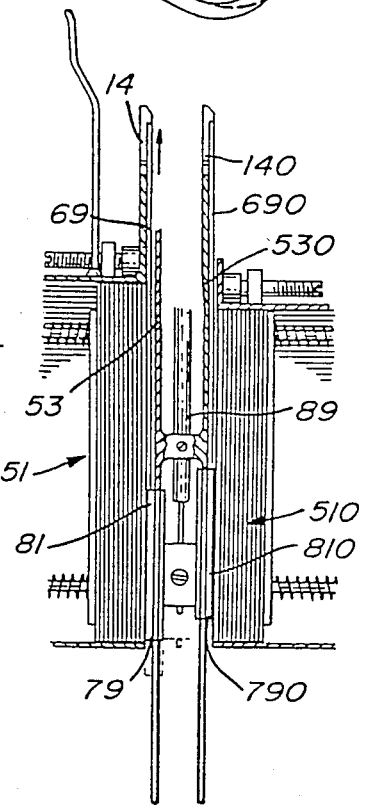
FIG. 10 illustrates an embodiment of the invention incorporating two back-to-back tag dispensers.
Figure 8:
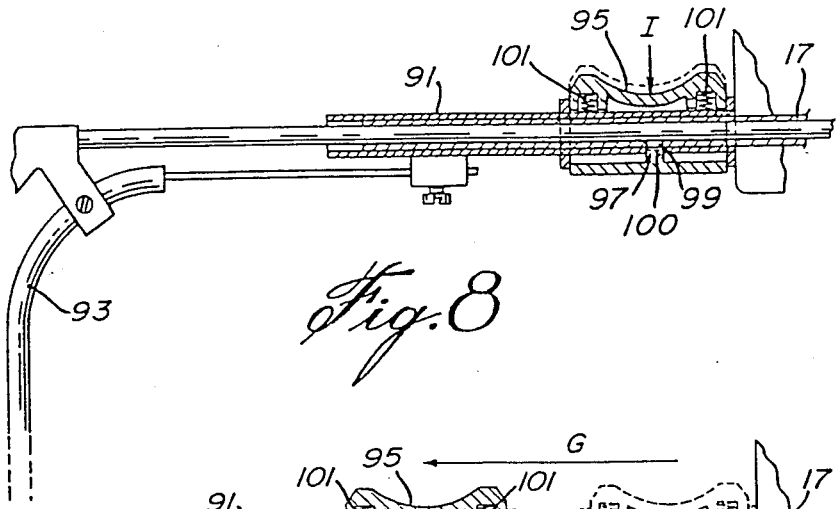
FIGS. 8 and 9 illustrate the operation of the thumb activated mechanism.

In some instances, it is necessary to fasten two tags to a product at the same time. An arrangement for automatically accomplishing this is also possible in accordance with the invention as illustrated in FIG. 10. As shown in FIG. 10, such an arrangement would use two back-to-back containers 51 and 510. The container 510 includes a dispensing wall 530, a backplate 140 and a dispensing opening 690. A single cable 89 is connected to both slider 79 of container 51 and slider 790 of container 510. Thus, by operation of the single cable 89, two tags will be dispensed at the same time.

The slider 790, and more importantly the pusher 810 of the container 510 can be made of a different height than the slider 79 and pusher 81 of the container 51. Accordingly, it is possible not only to fasten two different tags at the same time, but to fasten two different tags of different sizes at the same time.

As will be apparent, it will be possible to construct a moving means as a separate attachment to the fastener dispensing device. It is also possible to construct the tag dispenser as a separate attachment to the device.

It is also possible to use the tag dispenser for apparatus other than the dispensing device illustrated herein so that the tag dispenser, especially the automatically operable embodiment, could be constructed as a separate device for use with other dispensing devices.

Finally, it is possible to construct the moving means and the tag dispenser as a single integral attachment. Thus, it is possible to improve the fastener dispensing device by the simple expedient of adding the appropriate attachment as required.

Alternatively, it is possible to integrally form with the fastener dispensing device the moving means or to integrally form with the fastener dispensing device the tag dispenser. Finally, the holding means and tag dispenser could be integrally formed with the fastener dispensing device. In any of the latter options, an integrally formed improved fastener dispensing device is provided.

It will also be apparent to one skilled in the art that although mechanical means are provided for causing movement of the moving means 13 and the slider 79, other means may provide this movement. For example, pneumatic arrangements (including air cylinders), as is well known in the art, could be provided for this purpose.

Although particular embodiments have been described, this was for the purpose of illustrating, but not limiting, the invention. Various modifications, which will come readily to the mind of one skilled in the art, are within the scope of the invention as defined in the appended claims.

I claim:

1. A tag dispenser for use with a fastener and tag dispensing device, comprising:

a tag container for containing a plurality of tags, said tag container having a top wall and a dispensing wall, wherein the tags are stackable in said container in parallel with said dispensing wall;

a dispensing opening in said top wall through which tags are dispensed one tag at a time from said container;

slide means, slideable along said dispensing wall, and having a pusher portion for pushing a tag partially out of said container through said dispensing opening;

means for moving said slide means up and down along said dispensing wall, said tag being pushed partially out of said container on the upward stroke of said slide means; and means for preventing retraction of said tag on the downward stroke of said slide means;

whereby, when a first tag is in a dispensing position along said dispensing wall, a second tag is engaged by said pusher portion and pushed up behind said first tag so that when said first tag is removed, said second tag will be in said dispensing position.

2. A dispenser as defined in claim 1 wherein said dispensing opening is disposed on the edge of said top wall adjacent the top edge of said dispensing wall.

3. A dispenser as defined in claim 2 and further including a guide wall extending downwardly from said dispensing wall;

a slot extending longitudinally along said guide wall and continuing partway along said dispensing wall;

said slide means being movable along said slot.

4. A dispenser as defined in claim 3 wherein said slide means comprises a slider portion, slideable in said slot, and a pusher portion, having a top edge, attached to said slider portion in the interior of said container;

whereby, the slider means can be lowered along said slot so that the top edge of the pusher portion underlies the container and whereby, when the slider means is subsequently raised, the top edge of the pusher portion will engage the bottom edge of a tag adjacent said dispensing wall and push the tag upwardly and out through said dispensing opening.

5. A dispenser as defined in claim 4 and further including spring means for maintaining the stack of tags in the interior of said container pressed toward said dispensing wall.

6. A dispenser as defined in claim 5 wherein said dispensing opening has an outer edge coincident with said dispensing wall and an inner edge spaced inwardly from said outer edge on the top wall;

backplate means extending upwardly from adjacent said inner edge, said backplate means including stop means spaced from the top edge of said dispensing wall;

whereby, a tag pushed out of said dispensing opening will slide along said backplate means and the upward motion of said tag will be arrested by said stop means.

7. A dispenser as defined in claim 6 wherein each tag to be dispensed has a common thickness and a common length;

the top edge of said pusher portion being raisable to only a predetermined level of said dispensing wall;

the distance from said predetermined level to said stop means being equal to said common length;

and further including spacer means on said dispensing wall on each side of said slot between said predetermined level and the bottom edge of said dispensing wall, said spacer means having a thickness equal to said common thickness;

the width of said dispensing opening being twice said common thickness; and the thickness of the top edge of said pusher portion being twice said common thickness.

8. A dispenser as defined in claim 7 wherein said means for moving is manually operable.

9. A dispenser as defined in claim 7 for use with a device having a movable trigger means;

said means for moving being movable in synchronism with the motion of said trigger means.

* * * * *